US009848682B2

(12) United States Patent
Zadvinskis et al.

(10) Patent No.: US 9,848,682 B2
(45) Date of Patent: Dec. 26, 2017

(54) COMPUTER CASE STRAP RETENTION SYSTEM

(71) Applicant: Shaun Jackson Design, Inc., Saline, MI (US)

(72) Inventors: Mark Zadvinskis, Saline, MI (US); Adam Ostroff, West Bloomfield, MI (US)

( * ) Notice: Subject to any disclaimer, the term of this patent is extended or adjusted under 35 U.S.C. 154(b) by 0 days.

(21) Appl. No.: 14/995,837

(22) Filed: Jan. 14, 2016

(65) Prior Publication Data

US 2017/0202331 A1 Jul. 20, 2017

(51) Int. Cl.

| | |
|---|---|
| ***A45C 13/30*** | (2006.01) |
| ***A45C 11/00*** | (2006.01) |
| ***A45C 13/10*** | (2006.01) |
| ***G06F 1/16*** | (2006.01) |

(52) U.S. Cl.

CPC ..... *A45C 13/30* (2013.01); *A45C 11/00* (2013.01); *A45C 13/103* (2013.01); *G06F 1/1613* (2013.01); *A45C 2011/003* (2013.01)

(58) Field of Classification Search

CPC ..... A45C 11/00; A45C 13/30; A45C 13/103; A45C 2011/003; G06F 1/1613; G06F 1/1628; G06F 1/1656

USPC ..... 206/45.23, 45.24, 320; 190/100–123, 190/900–902

See application file for complete search history.

(56) References Cited

U.S. PATENT DOCUMENTS

| | | | | |
|---|---|---|---|---|
| 2,907,420 | A * | 10/1959 | Doppelt | A45C 7/0022 190/103 |
| 5,826,770 | A * | 10/1998 | Chuang | G06F 1/1628 190/100 |
| 5,908,147 | A * | 6/1999 | Chuang | G06F 1/1628 190/100 |
| 6,321,912 | B1 * | 11/2001 | Lippert | A45C 5/14 206/320 |
| 9,427,057 | B2 * | 8/2016 | Fenton | A45C 11/00 |
| 9,655,420 | B2 * | 5/2017 | Mathews, Jr. | A45C 11/00 |
| 2016/0209881 | A1 * | 7/2016 | Fenton | A45C 11/00 |

* cited by examiner

*Primary Examiner* — Bryon Gehman
(74) *Attorney, Agent, or Firm* — John G. Posa; Belzer PC

(57) ABSTRACT

With respect to cases for laptop computers, and the like and, an improvement comprises pair of opposing strap guides through which elastic side retention straps are respectively journaled to prevent the straps from interfering with the closure of the case. A case according to the invention comprises top and bottom covers hinged in the rear of the case, and a closure mechanism such as a zipper is for closing the top and bottom covers. Right and left elastic retaining straps respectively connect the top and bottom portions of the case, and the right and left elastic retaining straps pass through respective strap guides, each attached to the inner surface of the top portion of the case, to prevent the retaining straps from being caught in the hinged portions of the computer or the closure mechanism as the case is closed. Each elastic retaining strap may twist between the bottom cover of the case and each strap guide.

7 Claims, 3 Drawing Sheets

COMPUTER CASE STRAP RETENTION SYSTEM

FIELD OF THE INVENTION

This invention relates generally to cases for laptop computers and the like and, in particular, to an improvement comprising pair of strap guides through which elastic side retention straps are respectively journaled to prevent the straps from interfering with the closure of the case.

BACKGROUND OF THE INVENTION

As shown in FIG. 1A, computer cases including laptop cases generally have a bottom cover 102 and a top cover 104 that close with a zipper 106, for example, to encase the computer. It is also common to have elastic side retention straps 110 that connect the bottom of the case to the top of the case to hold the top of the case against the display portion 112 of the computer 114 when it is opened for use. A long-standing problem with the traditional design described above is that the side straps 110 get caught in the computer, or the zipper, when the case is closed.

FIG. 1B shows how the strap 110, no longer stretched, can get caught in the hinged keyboard and display portions of the computer 114, and FIG. 1C illustrates how the strap 110 can get caught in the zipper 106, causing the user to push the strap back into the case to continue closing the case. Indeed, straps 110 often get caught in the hinge of the laptop or the zippers when closing. If the strap is caught in the computer, it may cause damage to the computer or may not allow it to go to sleep. If caught in the zipper, the strap can tear or ruin the zipper if pulled too hard.

SUMMARY OF THE INVENTION

This invention relates generally to cases for laptop computers and the like and, in particular to an improvement comprising pair of strap guides through which elastic side retention straps are respectively journaled to prevent the straps from interfering with the closure of the case.

In particular, the invention is applicable to a case for a computer such as a laptop computer having a display portion hinged to a keyboard portion. The invention is not limited in this regard and applies equally well to other types of portable electronic devices such as tablets. The case comprises a bottom cover having an inner surface with a periphery and front, back, right and left sides corresponding to the keyboard portion of the computer; and a top cover having an inner surface with a periphery and front, rear, right and left sides corresponding to the display portion of the computer. The top and bottom covers are hinged in the rear of the case, and a closure mechanism such as a zipper is provided for closing the top and bottom portions of the case.

Right and left elastic retaining straps respectively connect the top and bottom portions of the case, and the right and left elastic retaining straps pass through respective strap guides, each attached to the inner surface of the top portion of the case, to prevent the retaining straps from being caught in the hinged portions of the computer or the closure mechanism as the case is closed.

Each elastic retaining strap has a flat surface defining a width and, in the preferred embodiment, the strap guides are wider than the retaining straps so that the flat surfaces of the straps slide against respective right and left inner surfaces of the top cover as the case is opened and closed.

Each elastic retaining strap has a first end attached to the inner surface of the top cover; and a second end attached to the bottom cover. At least the bottom cover may be attached to a side portion with a peripheral seam, whereby the second end of each strap may be sewn into a different portion of the peripheral seam. As such, each elastic retaining strap twists from where it is sewn into the peripheral seam to where it enters a strap guide. In an alternative embodiment, the strap guides are sufficiently long to cover the ends of the elastic retaining straps where they attach to the inner surface of the top cover of the case.

DETAILED DESCRIPTION OF THE INVENTION

This invention solves strap retention problems associated with portable computer cases by providing strap guides, which may be in the form of loops of longer channels, to keep the side straps from being caught in the computer or closure.

Figure 1A:
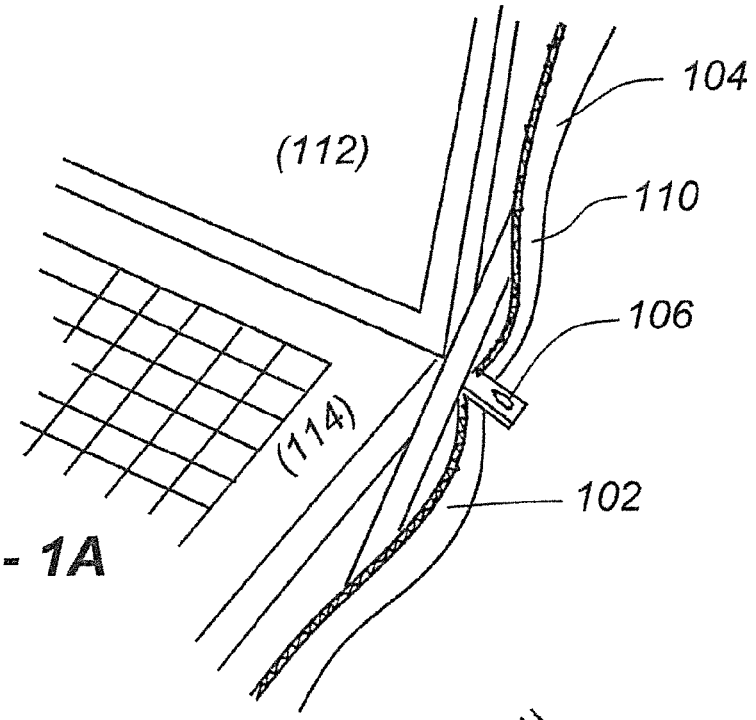
FIG. 1A is a drawing of a prior-art computer case illustrating a side retention strap.
Figure 1B:
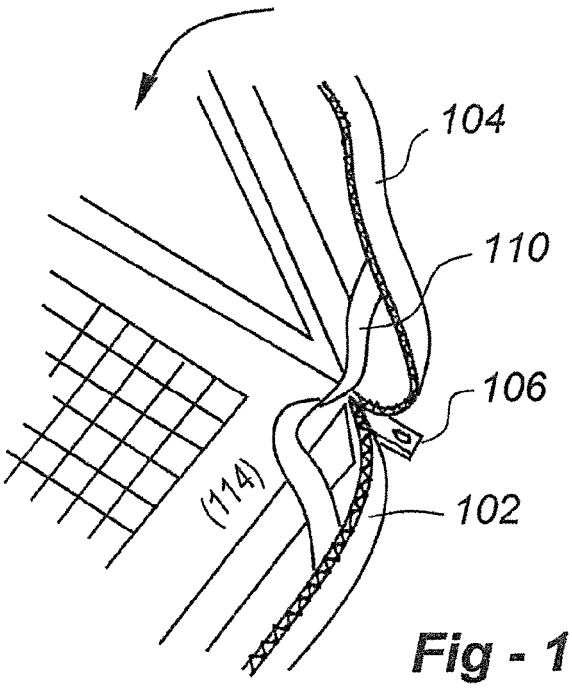
FIG. 1B shows how a side strap, no longer stretched, can get caught in the hinged keyboard and display portions of the computer.
Figure 1C:
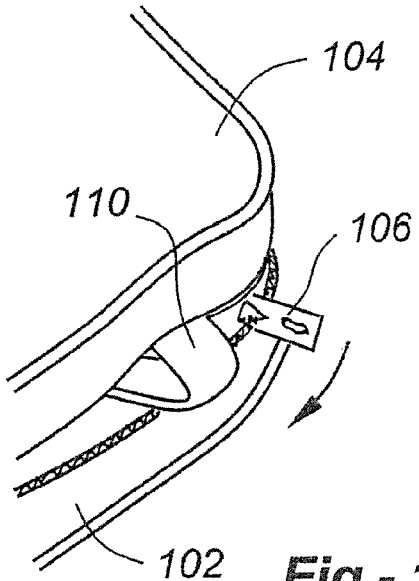
FIG. 1C illustrates how a side strap can get caught in the zipper, causing the user to push the strap back into the case to continue closing the case.
Figure 2:
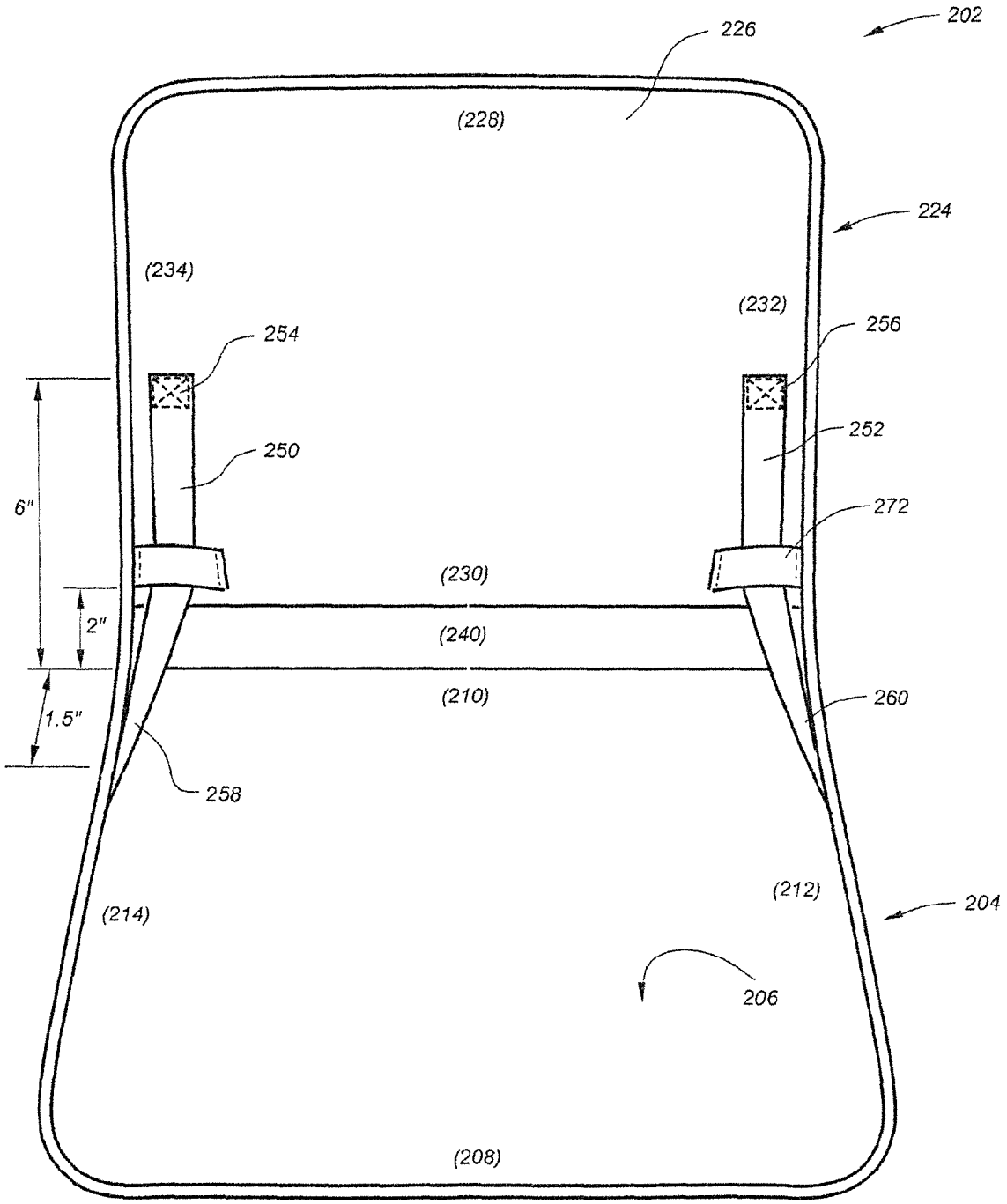
FIG. 2 is drawing that illustrates a preferred embodiment of a computer case as seen by a user, but without the computer for the sake of clarity.

FIG. 2 is drawing that illustrates a preferred embodiment of a computer case 202 as seen by a user, but without the computer for the sake of clarity. The case 202 includes a bottom cover 204 having an inner surface 206 with a periphery and front, back, right and left edges (208, 210, 212, 214, respectively) corresponding to the base or keyboard portion of the computer, and a top cover 224 having an inner surface 226 with a periphery and front, rear, right and left edges (228, 230, 232, 234) corresponding to the display portion of the computer. The top and bottom covers are hinged at 240 in the rear of the case, and a closure mechanism is provided for closing the top and bottom covers. Typically the closure is a zipper that runs along the front, right and left sides of the top and bottom covers.

In accordance with the invention, right and left elastic retaining straps, 250, 252, respectively, connect the top and bottom covers of the case. In the preferred embodiment the straps have a width on the order of ¾", though other smaller and larger widths are possible, including ½" and 1 inch or more. Each of the straps 250, 252 strap has a first end fastened in a region on a respective right and left side of the inner surface of the top cover at a few inches above or away from the bottom of the hinge. Such fastening regions, depicted at 254, 256, may be about 4, 5, 6, 7, 8 inches or more from the spine or bottom of the case. In the preferred embodiment, these regions are in the range of 5 to 6 inches to the spine, and proximate to, if not at, the right and left edges of the top cover.

Each retention strap 250, 252 has a second end 258, 260 attached to the bottom cover near or at the left and right side edges, respectively, as shown in FIG. 2. In the preferred embodiment, each strap 250, 252 is further guided through respective right and left strap guides 270, 272 attached to the inner surface of the top portion of the case on opposing sides. These strap guides, unique to the invention, prevent the retaining straps from being caught in the hinged portions of the computer or the closure mechanism as the case is closed.

In the preferred embodiment, the second ends 258, 260 of the side straps are sewn into the seam that attaches the bottom cover to left and right sides portions of the case to which the zipper is attached. When sewn in this way, the ends 258, 260 are more or less vertical where they attach, but twist before going through the strap guides such that the straps against the inner surface 226 of the top cover 224. As seen in the drawing, the straps twist by up to 90 degrees from the lower portion of the case to strap guides. Alternatively the straps 250, 252 may be sewn straight and flat directly to the bottom cover without a twist. That is, in this embodiment each strap will enter straight or flat into its respective strap guide.

Figure 3:
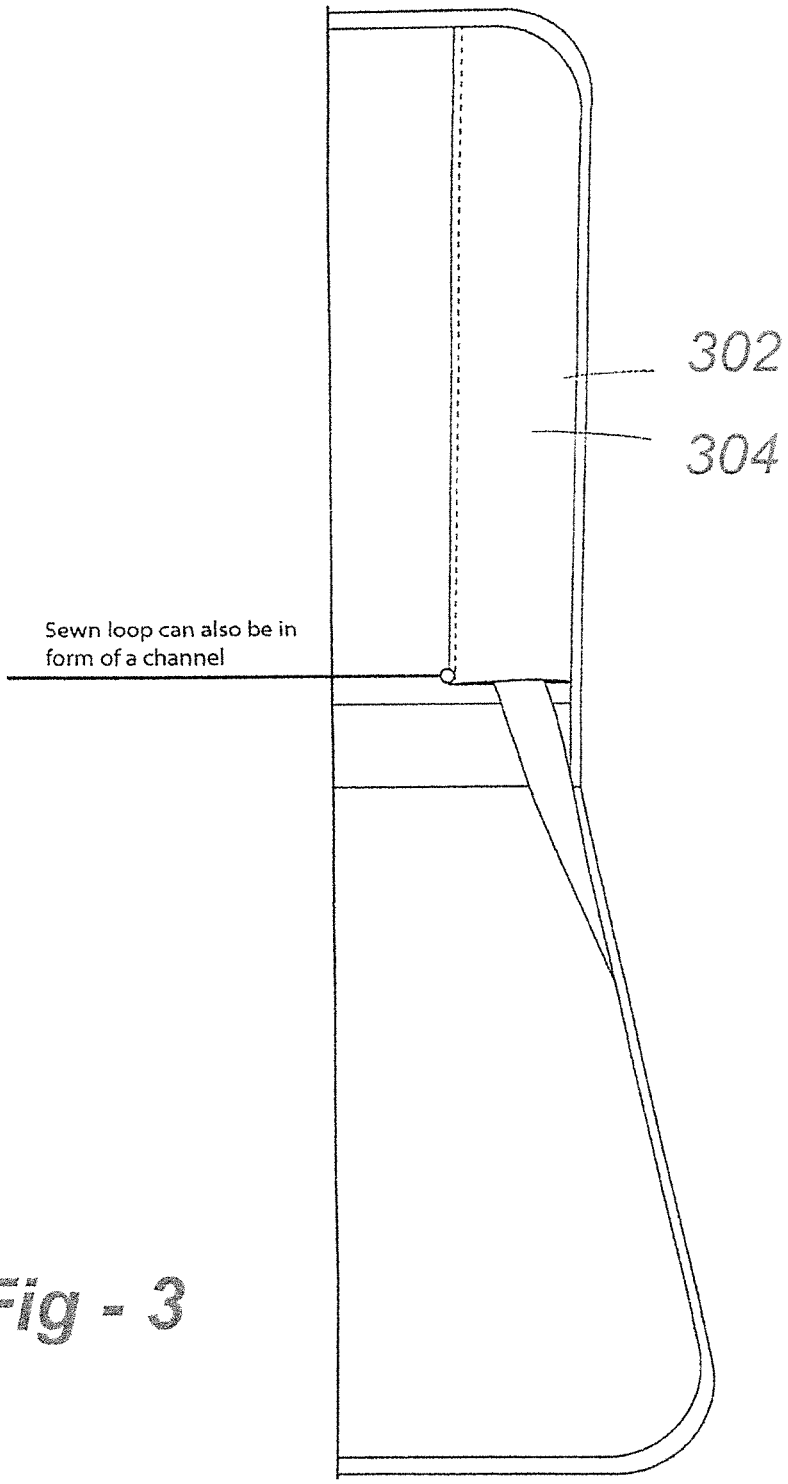
FIG. 3 shows how the strap guides may cover more of the upper portions of the straps and may, indeed, cover the areas where the straps attach to the inner surface of the top cover.

The strap guides may vary in length along the inner surface of the top portion of the case. As illustrated in FIG. 3, the strap guides 302 may cover more of the upper portions of the straps as compared to FIG. 2 and may, indeed, cover the areas 304 where the straps attach to the inner surface of the top cover.

The invention claimed is:

1. A case for a computer having a display portion hinged to a keyboard portion, the case comprising:

a bottom cover having an inner surface with a periphery and front, back, right and left sides corresponding to the keyboard portion of the computer;

a top cover having an inner surface with a periphery and front, back, right and left sides corresponding to the display portion of the computer;

wherein the top and bottom covers are hinged along the back sides of the bottom and top covers of the case;

a closure mechanism for closing the top and bottom covers of the case;

right and left elastic retaining straps, each strap having a first end connected to the top cover and a second end connected to the bottom cover;

right and left strap guides respectively provided on opposing sides of the inner surface of the top portion of the case, each strap guide comprising a layer of material with opposing side edges attached to the inner surface of the top portion of the case, thereby creating a tunnel between each strap guide and the inner surface of the top portion of the case; and wherein each elastic retaining strap passes through a respective one of the tunnels and extends from a lower opening in each respective tunnel, and wherein the lower openings of each tunnel are proximate to the hinged, back portion of the case to prevent the retaining straps from being caught in the hinged portions of the computer or the closure mechanism as the case is closed.

2. The case of claim 1, wherein the closure mechanism includes a zipper.

3. The case of claim 1, wherein:

each elastic retaining strap has a flat surface defining a width; and the tunnels have inner widths that are wider than the width of the retaining straps so that the straps slide within the tunnels as the case is opened and closed.

4. The case of claim 1, wherein:

each elastic retaining strap has a first end attached to the inner surface of the top cover; and a second end attached to the bottom cover.

5. The case of claim 4, wherein:

at least the bottom cover is attached to a side portion with a peripheral seam; and the second end of each strap is sewn into a different portion of the peripheral seam.

6. The case of claim 5, wherein:

each elastic retaining strap twists from where it is sewn into the peripheral seam to where it enters a respective one of the tunnels.

7. The case of claim 1, wherein the tunnels are sufficiently long to cover the first ends of the elastic retaining straps.

* * * * *